US005949383A

United States Patent [19]

Hayes et al.

[11] Patent Number: 5,949,383

[45] Date of Patent: Sep. 7, 1999

[54] COMPACT ANTENNA STRUCTURES INCLUDING BALUNS

[75] Inventors: Gerard James Hayes, Wake Forest; Robert Ray Horton, Apex, both of N.C.

[73] Assignee: Ericsson Inc., Research Triangle Park, N.C.

[21] Appl. No.: 08/953,939

[22] Filed: Oct. 20, 1997

[51] Int. Cl.[6] ..... H01Q 9/16; H01Q 1/24

[52] U.S. Cl. ..... 343/795; 343/790; 343/700 MS; 343/820

[58] Field of Search ..... 343/790, 791, 343/793, 792, 795, 700 MS, 821, 820, 895

[56] References Cited

U.S. PATENT DOCUMENTS

| | | | |
|---|---|---|---|
| 2,297,513 | 9/1942 | Von Baeyer | 343/791 |
| 4,495,505 | 1/1985 | Shields | 343/821 |
| 4,746,925 | 5/1988 | Toriyama | 343/713 |
| 4,825,220 | 4/1989 | Edward et al. | 343/795 |
| 5,387,919 | 2/1995 | Lam et al. | 343/821 |
| 5,440,317 | 8/1995 | Jalloul et al. | 343/791 |
| 5,526,003 | 6/1996 | Ogawa et al. | 343/700 MS |
| 5,532,708 | 7/1996 | Krenz et al. | 343/795 |

OTHER PUBLICATIONS

International Searh Report, PCT/US98/21284, Feb. 9, 1999.

Johnson et al., "*Antenna Engineering Handbook, Second Edition*", McGraw–Hill Book Company, pp. 42–8,42–10—42–13, 43–43—43–27.

IBM Technical Disclosure Bulletin, "*Printed Dipole With Printed Balun*", vol. 40, No. 6, Jun. 1997, pp. 127–130.

*Primary Examiner*—Don Wong
*Assistant Examiner*—James Clinger
*Attorney, Agent, or Firm*—Myers Bigel Sibley & Sajovec

[57] ABSTRACT

An antenna structure includes a center feed dipole antenna having first and second radiating sections that extend along a substrate from a center feed point. A feed section is electrically coupled to the center feed point. The feed section includes a radio frequency input line and a ground line extending along the substrate adjacent one another. A balun extends along the substrate between the first radiating section and the ground line. The first radiating section, the radio frequency input line, the ground line and the balun preferably extend along the substrate in parallel. A tuning shunt may also be provided across the balun for dual band operation. Accordingly, compact dual band antenna structures including baluns may be provided.

28 Claims, 4 Drawing Sheets

COMPACT ANTENNA STRUCTURES INCLUDING BALUNS

FIELD OF THE INVENTION

This invention relates to antenna structures, and more particularly to printed antenna structures.

BACKGROUND OF THE INVENTION

Printed antenna structures, also referred to as printed circuit board antenna structures, are widely used to provide compact antennas that can be integrated with other microelectronic devices on a substrate. For example, printed antenna structures may be used with cellular radiotelephones, portable computers and other compact electronic devices.

Printed antenna structures often include a center feed dipole antenna that can provide omnidirectional radiation. The center feed dipole antenna is a balanced device. Since the input to the antenna is typically provided by an unbalanced input, a balanced-to-unbalanced converter, also referred to as a "balun", is also generally provided. See, for example, IBM Technical Disclosure Bulletin, Vol. 40, No. 6, June 1997, pp. 127–130 entitled "*Printed Dipole With Printed Balun*".

It is also often desirable to provide a printed antenna structure that can operate in multiple bands. For example, a cellular telephone may operate in a conventional analog (800 MHz) band and also in a PCS band at around 1900 MHz. It is desirable to provide a single antenna structure that can operate in both bands. For example, U.S. Pat. No. 5,532,708 to Krenz et al. entitled "Single Compact Dual Mode Antenna" discloses a printed circuit board antenna that includes an electronic switch, so that a single compact radiating structure consisting of a split dipole antenna with associated balun structure may be selectively driven in either of two modes.

As cellular telephones, PCS devices and computers become more compact, there continues to be a need for more compact printed antenna structures including baluns. There is also a continued need for compact printed antenna structures including baluns that can operate in at least two bands.

SUMMARY OF THE INVENTION

It is therefore an object of the present invention to provide improved printed antenna structures including baluns.

It is another object of the present invention to provide printed antenna structures including baluns that can occupy a reduced area on a substrate.

It is yet another object of the present invention to provide compact printed antenna structures including baluns that can operate over dual bandwidths.

These and other objects are provided, according to the present invention, by an antenna structure that includes a center feed dipole antenna having first and second radiating sections that extend along a substrate from a center feed point. A feed section is electrically coupled to the center feed point. The feed section includes a radio frequency input line and a ground line extending along the substrate adjacent one another. A balun extends along the substrate between the first radiating section and the ground line. The first radiating section, the radio frequency input line, the ground line and the balun preferably extend along the substrate in parallel. Accordingly, compact printed antenna structures including baluns may thereby be provided.

In one embodiment of the invention, the feed section includes a radio frequency input line and first and second ground lines on opposite sides thereof and extending along the substrate adjacent thereto. The balun includes a first balun section extending between the first radiating section and the first ground line, and a second balun section extending adjacent the second ground line opposite the radio frequency input line. A third radiating section may also be included, that extends along the substrate from the center feed point, adjacent the second balun section and opposite the second ground section. The first and third radiating sections, the radio frequency input line, the first and second ground lines and first and second balun sections preferably extend along the substrate in parallel.

According to another aspect of the invention, a tuning shunt is provided that extends along the substrate between the first and second balun sections. The tuning shunt functions as a parasitic strip that enables coupling across the balun at a higher frequency, such as 1900 MHz, while remaining virtually transparent at a lower frequency, such as 800 MHz. Accordingly, dual band operation may be provided.

In one embodiment, the above-described antennas are provided on a substrate that includes first and second opposing faces. The center feed dipole antenna, the feed section and the balun are on the first face embodied as a coplanar waveguide. The tuning shunt is on the second face.

In another embodiment, the substrate includes first and second layers. The radiating section and the radio frequency input line are included in the first layer and the first radiating section, the ground line and the balun are included in the second layer to provide a microstrip. A third layer may also be provided, and the tuning shunt is included in the third layer.

DETAILED DESCRIPTION OF THE PREFERRED EMBODIMENTS

Figure 1A:
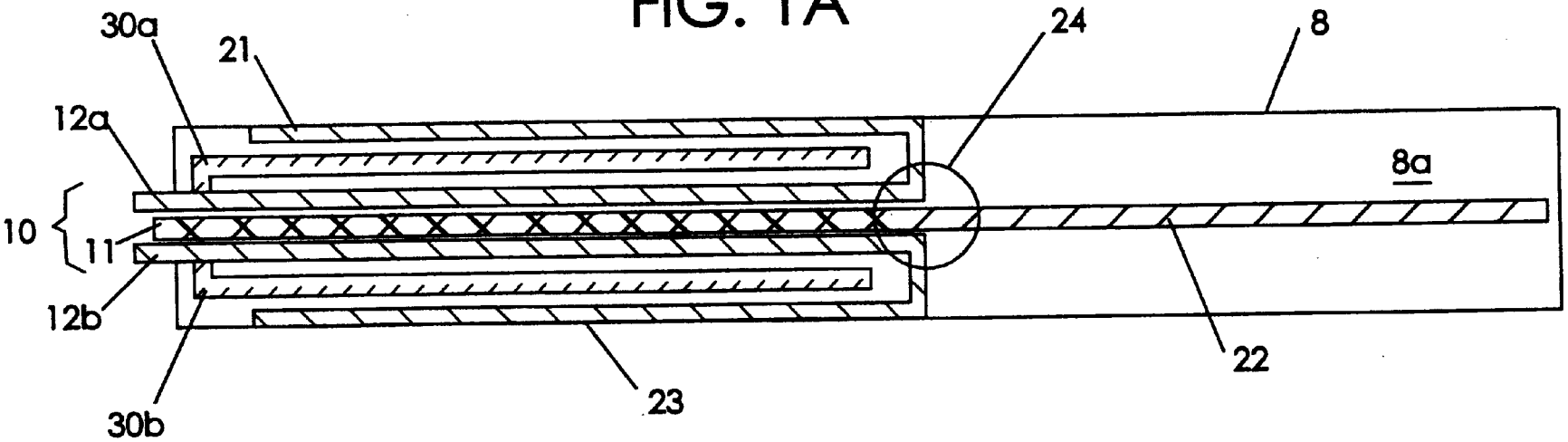
FIGS. 1A and 1B are top and bottom views respectively, of coplanar waveguide antennas according to the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout.

Figure 1B:
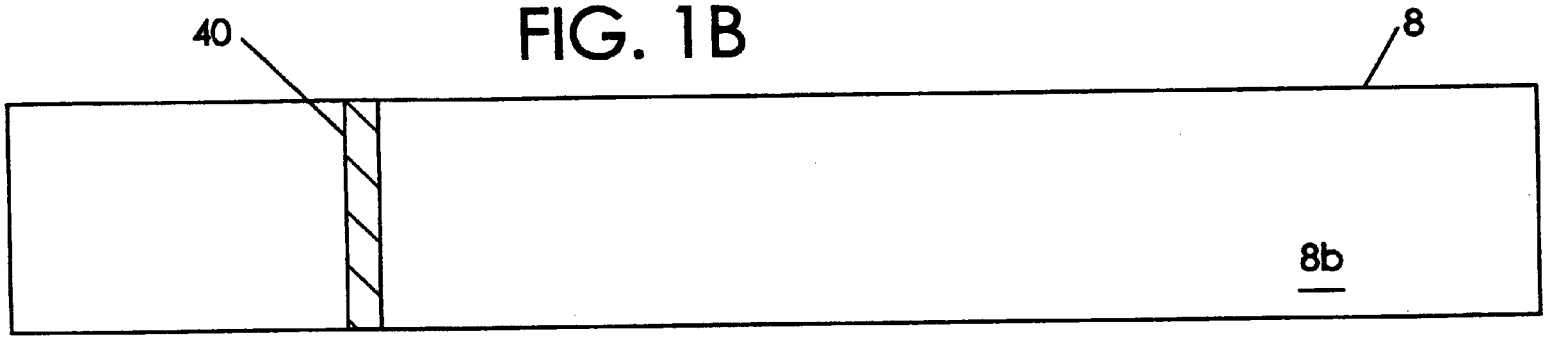

Referring now to FIGS. 1A and 1B, a top view and a bottom view respectively of antenna structures according to the invention will now be described. As shown in FIGS. 1A and 1B, antenna structures according to the invention are provided on a substrate 8 which may be a printed circuit board or other conventional substrate. Other a microelectronic circuitry may be included on substrate 8. FIGS. 1A and 1B illustrate a coplanar waveguide embodiment of antenna structures of the present invention. As shown, a center feed dipole antenna is included on first face 8*a* of substrate 8. The center feed dipole antenna includes a first radiating section 21 and a second radiating section 22. The first radiating section 21 and second radiating section 22 extend along substrate 8 from a center feed point 24. Radiating sections 21 and 22 are generally quarter wavelength sections, to provide a dipole antenna.

A feed section 10 in the form of a coplanar waveguide is electrically coupled to the center feed point 24. The feed section includes a radio frequency input line 11 and a pair of ground lines 12*a* and 12*b* extending along the substrate adjacent the radio frequency input line 11.

Still referring to FIG. 1A, a balun including a first balun section 30*a* extends along the substrate 8 between the first radiating section 21 and the ground line 12*a*. Preferably, the balun also includes a second balun section 30*b* that extends adjacent the second ground line 12*b* opposite the RF input line 11.

For symmetry, the center feed dipole antenna can include a third (quarter wavelength) radiating section 23 that extends along the substrate from the center feed point 24 adjacent the second balun section 30*b* and opposite the second ground section 12*b*. The first radiating section 21, the third radiating section 23, the radio frequency input line 11, the pair of ground lines 12*a* and 12*b* and the first and second balun sections 30*a* and 30*b* preferably extend along substrate 8 in parallel.

The above-described components are preferably located on first face 8*a* of substrate 8. On the second face 8*b*, as shown in FIG. 1B, a conductive tuning shunt 40 is provided. The tuning shunt extends from adjacent the first balun section 30*a* to adjacent the second balun section 30*b*. However, as illustrated in FIG. 1B, it can also extend from adjacent the first radiating section 21 to adjacent the third radiating section 23. The tuning shunt preferably extends orthogonal to the balun 30. The tuning shunt is used to shunt the balun 30 for radiation at a second, higher band of operation, to provide dual band operation.

Additional discussion of coplanar waveguide antennas of FIGS. 1A and 1B will now be provided. It is known to provide conventional cylindrical dipole antennas with a sleeve or bazooka balun. In these conventional antennas, a coaxial cable is generally used as an input feed. The coaxial cable includes an inner conductor and a coaxial shield. The dipole antenna includes a pair of radiating elements and a cylindrical sleeve or bazooka balun. The present invention stems from the realization that a printed antenna structure can be provided by taking a cross-section of a conventional cylindrical dipole antenna with a sleeve or bazooka balun to provide a two-dimensional structure such as that shown in FIG. 1A. Thus, the feed section 10 may be analogized to a cross-section of a coaxial cable. The balun sections 30*a* and 30*b* may be analogized to a cross-section of a sleeve balun, and the first, second and third radiating sections may be analogized to a cross-section of a conventional cylindrical dipole.

In a dual band antenna, the dipole radiating sections 21, 22 and 23 are generally quarter wavelength sections at the lower band of operation. The balun also comprises quarter wavelength sections 30*a* and 30*b* at the lower band of operation. The conductive tuning element 40 is used to shunt the balun for operation at a second, higher band of the operation.

Accordingly, high performance, low-cost antenna structures may be provided with 50Ω input impedance that can function at multiple bands, such as 800 MHz and 1900 MHz. The antenna structures of FIGS. 1A and 1B can radiate as a center fed dipole with half of the radiating section 22 extending from the center conductor 11 of the coplanar waveguide and the other half of the radiating section 21 and 23 extending from the ground lines 12*a* and 12*b* respectively. The dipole typically has a length that is an integer multiple of half wavelengths. The balun 30 enables radio frequency energy to be coupled from the balanced coplanar waveguide 10 and dipole to an unbalanced feed, such as a coaxial connector or microstrip section.

The tuning shunt 40 is placed along the balun at a location approximately one quarter wavelength of the higher frequency away from the center feed point 24. The tuning shunt enables coupling across the balun at a higher frequency band, such as 1900 MHz, while remaining virtually transparent at a lower frequency band, such as 800 MHz. By constructing the antenna using quarter wavelength sections at the lower band of operation and placing the parasitic element to tune for operation at the higher band of operation, a dual band antenna with a 50Ω input impedance at both frequencies can be realized.

Figure 2:
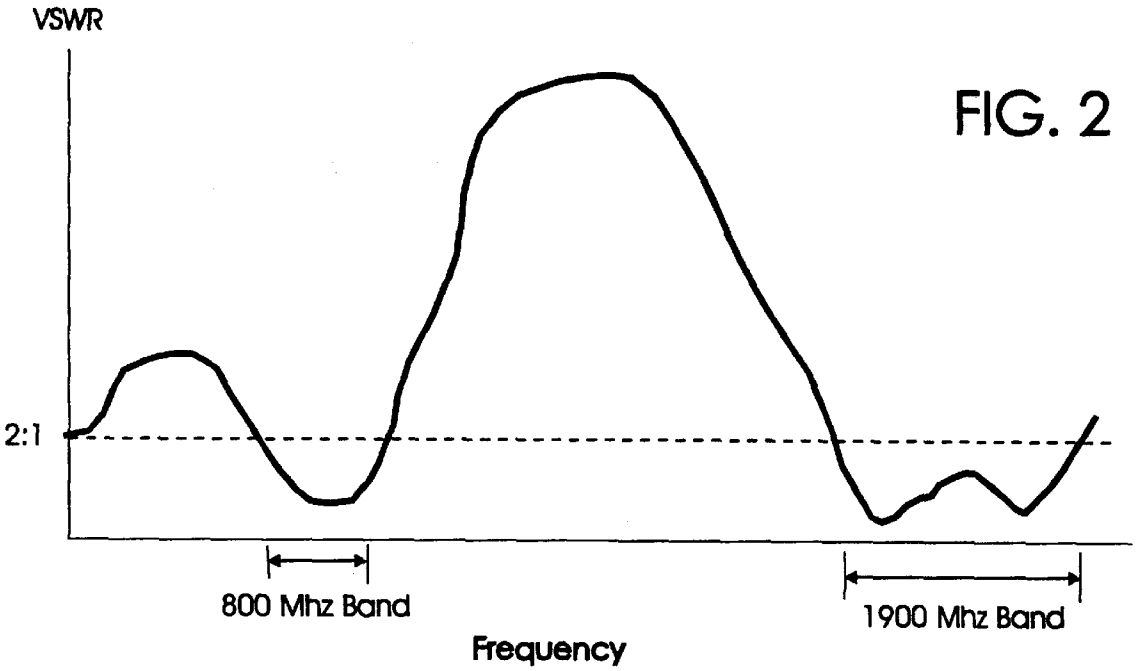
FIG. 2 illustrates input impedance Voltage Standing Wave Ratio (VSWR) of an antenna of FIG. 1.
Figure 3A:
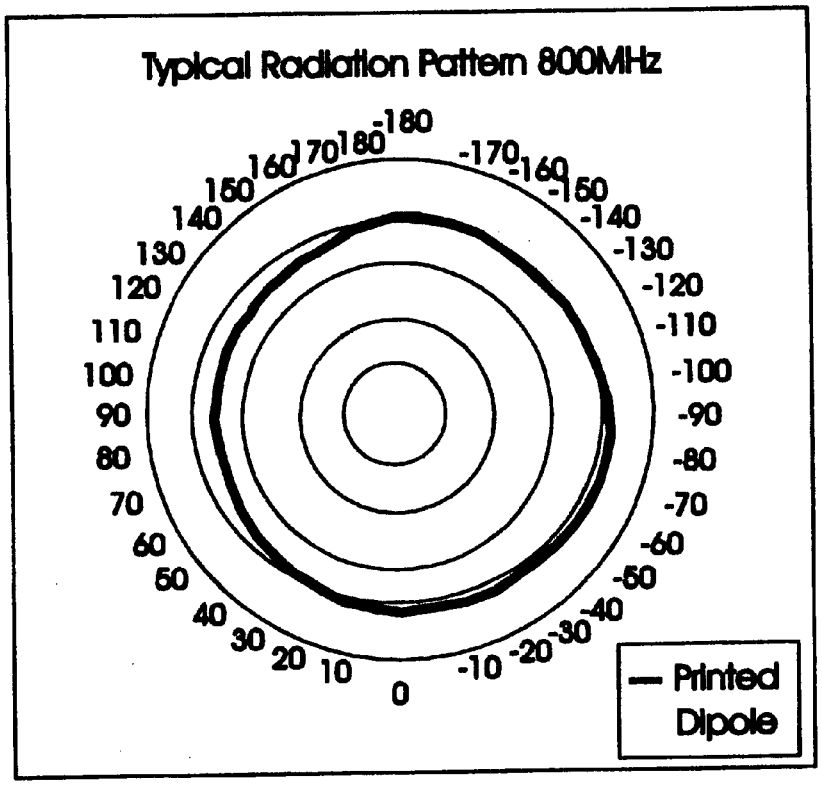
FIGS. 3A and 3B illustrate radiation patterns at 800 MHz and 1900 MHz respectively of an antenna of FIG. 1.
Figure 3B:
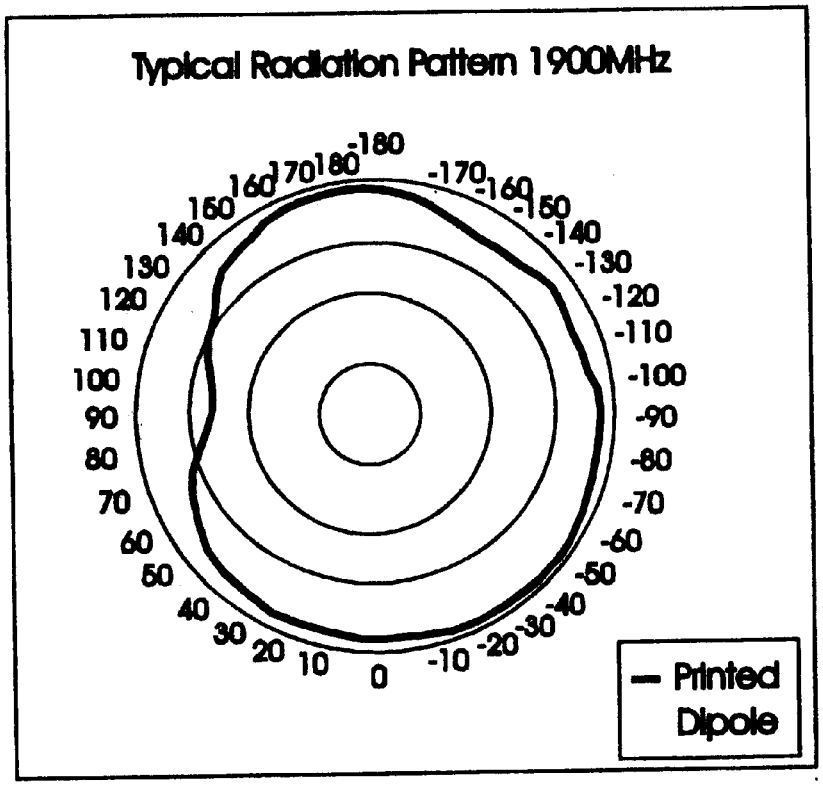

FIG. 2 illustrates input impedance Voltage Standing Wave Ratio (VSWR) of an antenna according to FIG. 1. FIGS. 3A and 3B illustrate radiation patterns at 800 MHz and at 1900 MHz respectively. Low VSWR and almost omnidirectional radiation patterns are obtained.

FIGS. 1A and 1B illustrated a coplanar waveguide embodiment of the present invention. However, as is understood by those having skill in the art, a coplanar waveguide is but one type of strip transmission line. In strip transmission lines, the conductors are flat strips that most frequently are photo-etched from a dielectric sheet which is copper-clad on one or both sides. There are several basic types of strip transmission lines including microstrip, strip line, slot line, coplanar waveguide and coplanar strip. See for example, "*Antenna Engineering Handbook*" by Johnson and Jasik, pp. 42–8 through 42–13 and 43–23 through 43–27.

Figure 4A:
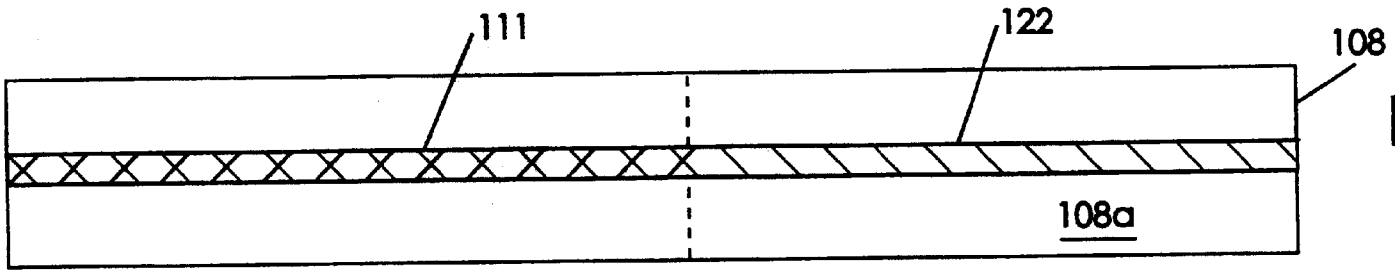
FIGS. 4A–4C illustrate first, second and third layers, respectively, of microstrip antennas according to the present invention.
Figure 4B:
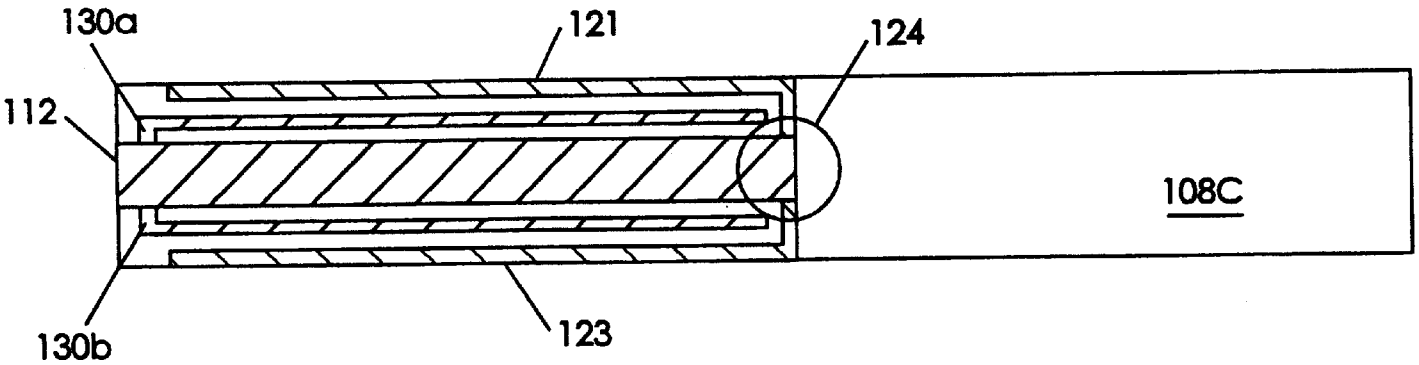
Figure 4C:
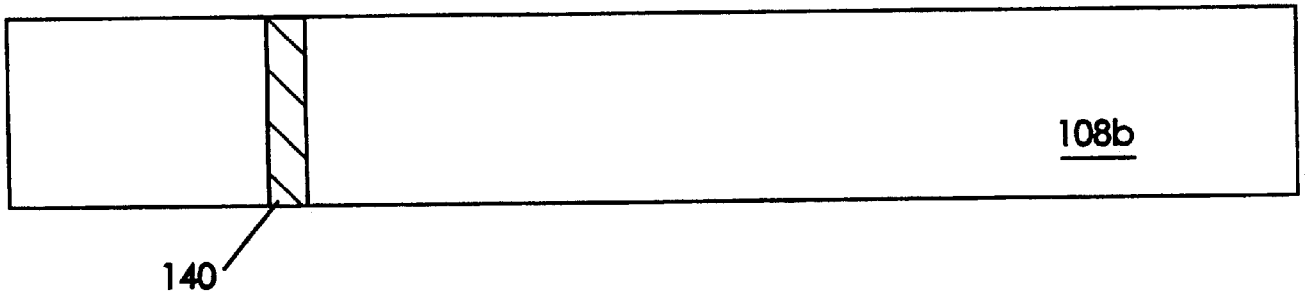

FIGS. 4A–4C illustrate microstrip antennas according to the present invention. In particular, FIGS. 4A–4C illustrate top, center and bottom layers of a multilayer substrate 108. As shown in FIG. 4A, top layer 108*a* of substrate 108 includes thereon a microstrip radio frequency input section 111 and a second radiating section 122 of the dipole. The middle layer 108*c* of substrate 108 includes a microstrip ground trace 112 and first and second balun sections 130*a* and 130*b* respectively. A first dipole radiating section 121 and an optional third dipole radiating section 123 are also provided. Finally, the bottom layer 108*b* of substrate 108 includes a tuning shunt 140.

The dipole, balun and tuning shunt may operate as was already described in connection with FIG. 1. The feed section is a microstrip feed section including a microstrip radio frequency input section 111 and a microstrip ground plane 112. The microstrip radio frequency input section is coupled to the dipole at the center feed point 124. As was the case with FIG. 1, the tuning shunt 140 may extend between the balun sections 130*a* and 130*b* or may extend between the first and third dipole sections 121 and 123 as illustrated.

Figure 5:
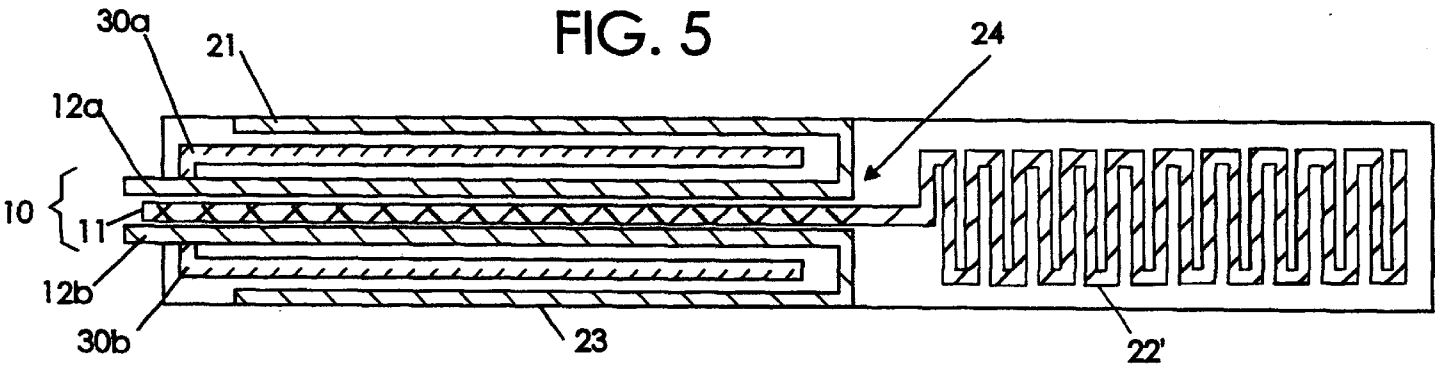
FIG. 5 illustrates an alternate embodiment of antennas of FIG. 1A.

FIG. 5 illustrates an alternate embodiment of FIG. 1A. As shown in FIG. 5, the second dipole radiating section may be a serpentine second dipole radiating section 22'. The second serpentine section 22' may take up less space on substrate 108, while still presenting a quarter wavelength effective electrical length. The serpentine section may also be used in the microstrip embodiment of FIG. 4A.

Accordingly, low-cost, lightweight, high-performance antennas may be provided, for example for cellular communication systems that are currently being integrated into various platforms including Personal Digital Assistants (PDA) and laptop computers. A balanced antenna, such as a dipole, may be used in these noisy environments to provide balanced noise rejection capabilities. Multiple band operations may be provided for dual mode operation.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An antenna structure comprising:

a substrate;

a center feed dipole antenna including first and second radiating sections that extend along the substrate from a center feed point;

a feed section electrically coupled to the center feed point, the feed section including a radio frequency input line and a ground line extending along the substrate adjacent one another; and a balun extending along the substrate between the first radiating section and the ground line.

2. An antenna structure according to claim 1 wherein the first radiating section, the radio frequency input line, the ground line and the balun extend along the substrate in parallel.

3. An antenna structure according to claim 1:

wherein the feed section includes a radio frequency input line and first and second ground lines on opposite sides thereof and extending along the substrate adjacent thereto; and wherein the balun includes a first balun section, extending between the first radiating section and the first ground line and a second balun section, extending adjacent the second ground line opposite the radio frequency input line.

4. An antenna structure according to claim 3 wherein the center feed dipole antenna further includes a third radiating section, extending along the substrate from the center feed point adjacent the second balun section and opposite the second ground section.

5. An antenna structure according to claim 3 wherein the first radiating section, the radio frequency input line, the first and second ground lines and the first and second balun sections extend along the substrate in parallel.

6. An antenna structure according to claim 4 wherein the first and third radiating sections, the radio frequency input line, the first and second ground lines and the first and second balun sections extend along the substrate parallel to one another.

7. An antenna structure according to claim 2 further comprising a tuning shunt that extends along the substrate between the radio frequency input line and the balun.

8. An antenna structure according to claim 5 further comprising a tuning shunt that extends along the substrate between the first and second balun sections.

9. An antenna structure according to claim 6 further comprising a tuning shunt that extends along the substrate between the first and second balun sections.

10. An antenna structure according to claim 1 wherein the substrate includes first and second opposing faces and wherein the center feed dipole antenna, the feed section and the balun are on the first face to provide a coplanar waveguide.

11. An antenna structure according to claim 3 wherein the substrate includes first and second opposing faces and wherein the center feed dipole antenna, the feed section and the balun are on the first face to provide a coplanar waveguide.

12. An antenna structure according to claim 4 wherein the substrate includes first and second opposing faces and wherein the center feed dipole antenna, the feed section and the balun are on the first face to provide a coplanar waveguide.

13. An antenna structure according to claim 2 wherein the substrate includes first and second opposing faces, wherein the center feed dipole antenna, the feed section and the balun are on the first face to provide a coplanar waveguide, and wherein the tuning shunt is on the second face.

14. An antenna structure according to claim 5 wherein the substrate includes first and second opposing faces, wherein the center feed dipole antenna, the feed section and the balun are on the first face to provide a coplanar waveguide, and wherein the tuning shunt is on the second face.

15. An antenna structure according to claim 6 wherein the substrate includes first and second opposing faces, wherein the center feed dipole antenna, the feed section and the balun are on the first face to provide a coplanar waveguide, and wherein the tuning shunt is on the second face.

16. An antenna structure according to claim 1 wherein the substrate includes first and second layers, wherein the second radiating section and the radio frequency input line are included in the first layer, and wherein the first radiating section, the ground line and the balun are included in the second layer.

17. An antenna structure according to claim 8 wherein the substrate includes first, second and third layers, wherein the second radiating section and the radio frequency input line are included in the first layer, wherein the first radiating section, the ground line and the balun are included in the second layer, and wherein the tuning shunt is included in the third layer.

18. A coplanar waveguide antenna structure comprising:

a coplanar waveguide feed section including a radio frequency input section and first and second ground sections, on a substrate face, a respective one of the ground sections being on a respective opposite side of the radio frequency input section;

first and second quarter wave dipole antenna sections on the substrate face, the first antenna section being electrically coupled to the radio frequency input section and the second antenna section being electrically coupled to the first ground section;

a first balun section on the substrate face, electrically coupled to the first ground section and extending between the first ground section and the second antenna section; and a second balun section on the substrate face, electrically coupled to the second ground section.

19. A coplanar waveguide antenna structure according to claim 18 further comprising a third antenna section on the substrate face, electrically coupled to the second ground section, and extending on the substrate face between the second ground section and the third antenna section.

20. A coplanar waveguide antenna according to claim 19 wherein the radio frequency input section, the first and second ground sections, the first and second balun sections and the second and third antenna sections extend along the substrate face in parallel.

21. A coplanar waveguide antenna structure according to claim 18 wherein the second antenna section extends along the substrate face in a serpentine manner.

22. A coplanar waveguide antenna structure according to claim 18 wherein substrate face is a first substrate face and wherein the substrate includes a second substrate face opposite the first substrate face, the antenna structure further comprising a tuning shunt on the second substrate face, extending between the first and second balun sections.

23. A coplanar waveguide antenna structure according to claim 19 wherein substrate face is a first substrate face and wherein the substrate includes a second substrate face opposite the first substrate face, the antenna structure further comprising a tuning shunt on the second substrate face extending between the second and third antenna sections.

24. A microstrip antenna structure comprising:

a substrate including first and second layers;

the first layer including a first microstrip radio frequency input section and a first quarter wave dipole antenna section electrically coupled thereto; and the second layer including a microstrip ground trace adjacent the first microstrip radio frequency input section, a first balun section adjacent a first side of the microstrip ground trace, a second balun section adjacent a second side of the microstrip ground trace, and a second quarter wave dipole antenna section adjacent the first balun section and opposite the microstrip ground trace.

25. A microstrip antenna structure according to claim 24 further comprising a third quarter wave dipole antenna section adjacent the second balun section and opposite the microstrip ground trace.

26. A microstrip antenna structure according to claim 24 wherein the first quarter wave dipole antenna section extends in the first layer in a serpentine manner.

27. A microstrip antenna structure according to claim 24 wherein the substrate further includes a third layer, the third layer including a tuning shunt that extends from adjacent the first balun section to adjacent the second balun section.

28. A microstrip antenna structure according to claim 25 wherein the substrate further includes a third layer, the third layer including a tuning shunt that extends from adjacent the second antenna section to adjacent the third antenna section.

* * * * *